US009631494B2

(12) United States Patent
Guenard

(10) Patent No.: US 9,631,494 B2
(45) Date of Patent: Apr. 25, 2017

(54) ROTOR STRUCTURE INCLUDING AN INTERNAL HYDRAULIC TENSION DEVICE

(75) Inventor: Denis Guenard, Givry (FR)

(73) Assignee: Thermodyn, Le Creusot (FR)

( * ) Notice: Subject to any disclaimer, the term of this patent is extended or adjusted under 35 U.S.C. 154(b) by 952 days.

(21) Appl. No.: 13/524,553

(22) Filed: Jun. 15, 2012

(65) Prior Publication Data

US 2012/0321465 A1 Dec. 20, 2012

(30) Foreign Application Priority Data

Jun. 16, 2011 (FR) ..... 11 55283

(51) Int. Cl.
*F01D 5/06* (2006.01)
*F04D 17/12* (2006.01)
*F04D 29/053* (2006.01)

(52) U.S. Cl.
CPC ..... *F01D 5/066* (2013.01); *F04D 17/12* (2013.01); *F04D 17/122* (2013.01); *F04D 29/053* (2013.01); *F05D 2230/60* (2013.01)

(58) Field of Classification Search
CPC . F01D 5/06; F01D 5/064; F01D 5/025; F01D 5/026; F04D 29/266; F04D 29/0405; F04D 29/043; F04D 29/044
See application file for complete search history.

(56) References Cited

U.S. PATENT DOCUMENTS 2,650,017 A * 8/1953 Pedersen et al. ..... 416/244 R
2,861,823 A * 11/1958 Perry ..... 416/135
3,365,125 A * 1/1968 Gaubatz ..... 415/173.7
3,715,176 A * 2/1973 Kerklo ..... 416/198 R
3,749,516 A * 7/1973 Samurin et al. ..... 416/199
4,191,485 A * 3/1980 Samurin et al. ..... 403/15
4,349,291 A * 9/1982 Geary, Jr. ..... 403/15
4,456,396 A * 6/1984 Damratowski ..... 403/15
4,510,894 A * 4/1985 Williams ..... 123/48 R
4,836,750 A * 6/1989 Modafferi et al. ..... 416/244 A
4,915,589 A * 4/1990 Gessler et al. ..... 416/241 B
(Continued)

FOREIGN PATENT DOCUMENTS

EP 2256347 A1 * 12/2010
GB 2272741 A 5/1994
(Continued)

OTHER PUBLICATIONS

European Search Report issued in connection with corresponding EP Application No. 12172197.1 on Jul. 7, 2014.
(Continued)

*Primary Examiner* — Nathaniel Wiehe
*Assistant Examiner* — Joshua R Beebe
(74) *Attorney, Agent, or Firm* — GE Global Patent Operation

(57) ABSTRACT

A rotor structure is provided. The rotor structure includes a plurality of wheels, a main axial tie rod passing through the plurality of wheels and a first shaft and a second shaft each attached to one extremity of the main tie rod, wherein the main tie rod and the bore of an end wheel in contact with one of the first and second shafts delimit a hydraulic chamber configured to receive a hydraulic fluid, and wherein the main tie rod, the hydraulic chamber and the end wheel form an internal hydraulic tension device configured to preload the main tie rod.

16 Claims, 4 Drawing Sheets

(56) References Cited

U.S. PATENT DOCUMENTS

| | | | | |
|---|---|---|---|---|
| 5,467,687 | A * | 11/1995 | Habegger | 92/165 R |
| 5,537,814 | A * | 7/1996 | Nastuk et al. | 60/796 |
| 6,267,553 | B1 * | 7/2001 | Burge | 415/115 |
| 6,772,682 | B1 * | 8/2004 | Daniel et al. | 100/347 |
| 2004/0189126 | A1 * | 9/2004 | Brunet et al. | 310/90.5 |
| 2007/0286733 | A1 * | 12/2007 | Bouchard | 416/204 R |
| 2008/0138148 | A1 * | 6/2008 | Landwehr | 403/15 |

FOREIGN PATENT DOCUMENTS

| | | | |
|---|---|---|---|
| GB | 2452932 | A | 3/2009 |
| JP | 03030501 | U | 3/1991 |
| RU | 2230195 | C2 | 6/2004 |

OTHER PUBLICATIONS

Unofficial English Translation of Japanese Office Action issued in connection with corresponding JP Application No. 2012-135469 on Mar. 29, 2016.

Russian Office Action issued in connection with corresponding RU Application No. 2012126493 on Oct. 14, 2016.

* cited by examiner

ROTOR STRUCTURE INCLUDING AN INTERNAL HYDRAULIC TENSION DEVICE

BACKGROUND OF THE INVENTION

Field of the Invention

Embodiments of the present invention concern the domain of rotors in rotating machines such as centrifugal compressors. More specifically, embodiments of the present invention relate to stacked rotor structures for axial compressors, pumps, axial or radial turbines, and electric motors including a plurality of wheels crossed by a central tie rod.

Description of the Related Art

A rotor may be made in different ways, in particular a rotor may include a single solid shaft on which elements, such as vane wheels, are assembled radially and locked using different means of transferring axial forces and torque.

A rotor may also include an axial stack of elements, such as vane wheels, assembled together using an axial preloading system, such as a central tie rod. The axial locking is provided by the preloading system, and the torque is then transmitted either by dry friction between the contact surfaces or using front cogging, such as in Hirth or Curvic couplings.

Embodiments of the present invention apply in particular to axial stacking rotors including a central tie rod arranged about the axis of the rotor.

There are axially stacked rotors including a central tie rod on which compressor wheels are mounted that is screwed at a first extremity into a first shaft end. The second extremity of the tie rod is inserted into a second shaft end and the second shaft end is bolted to one of the wheels. There are also axially stacked rotors including a tie rod passing through the second shaft end and attached using a nut. A hydraulic tool is then mounted onto the second extremity of the tie rod and it presses against the second shaft end in order to preload the tie rod.

However, such a configuration is complex and adds offset weight to the extremity of the rotor. Furthermore, the diameter of the central tie rod is dependent on the diameter of the shaft ends. Consequently, the load capacity cannot be increased. The length of the central tie rod in such configurations cannot be reduced.

In order to have a shorter central tie rod having a larger diameter, the second shaft end could be assembled using a bolting flange. However, such an assembly is more complex and prevents precise control of the preloading of the screw-tightened bolting flange.

Reference may also be made to document U.S. Pat. No. 3,749,516, which describes a stacked rotor comprising a central tie rod screwed at both extremities thereof into the two shaft ends. The tie rod is preloaded and centred by a central mechanical system, by screw tightening and/or by preheating the tie rod. Such a solution also prevents the preloading of the tie rod from being precisely controlled.

In view of the foregoing, the purpose of embodiments of the present invention is to overcome the drawbacks related to rotors having a central tie rod.

BRIEF SUMMARY OF THE INVENTION

According to an embodiment of the present invention a rotor structure is provided. The rotor structure includes a plurality of wheels, a main axial tie rod passing through the plurality of wheels and a first shaft and a second shaft each attached to one extremity of the main tie rod, wherein the main tie rod and the bore of an end wheel in contact with one of the first and second shafts delimit a hydraulic chamber configured to receive a hydraulic fluid, and wherein the main tie rod, the hydraulic chamber and the end wheel form an internal hydraulic tension device configured to preload the main tie rod.

According to another embodiment of the present invention, a method for assembling a rotor structure having a plurality of wheels, a main axial tie rod passing through the plurality of wheels and a first shaft and a second shaft is provided. The method comprises assembling the plurality of wheels is with the first shaft, centering a first end of the main tie rod on the first shaft and attaching the first end of the main tie rod to the first shaft, pressurizing a hydraulic chamber, the hydraulic chamber being delimited by two shoulders of the main tie rod and the bore of an end wheel, or by two shoulders of an annular element attached to the main tie rod, positioning and attaching the second shaft to a second end of the main tie rod opposite the first end of the main tie rod, such that the second shaft is closer to the end wheel, and releasing the pressure and draining the hydraulic chamber.

BRIEF DESCRIPTION OF THE DRAWINGS

Other objectives, characteristics and advantages of the invention are set out in the description below, given purely by way of non-limiting example and in reference to the attached drawings, in which.

DETAILED DESCRIPTION OF THE INVENTION

Figure 1:
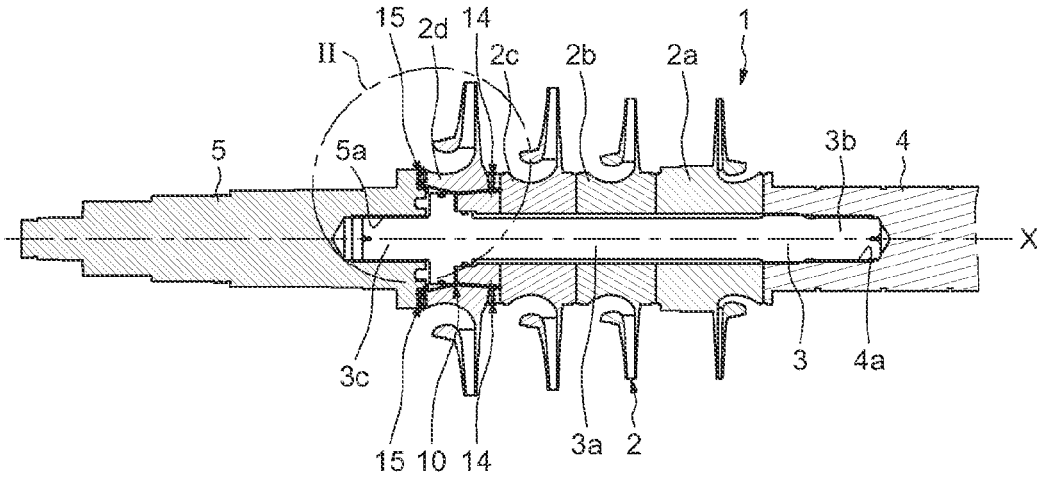
FIG. 1 is an axial cross section of a rotor structure according to an embodiment of the invention.
Figure 2:
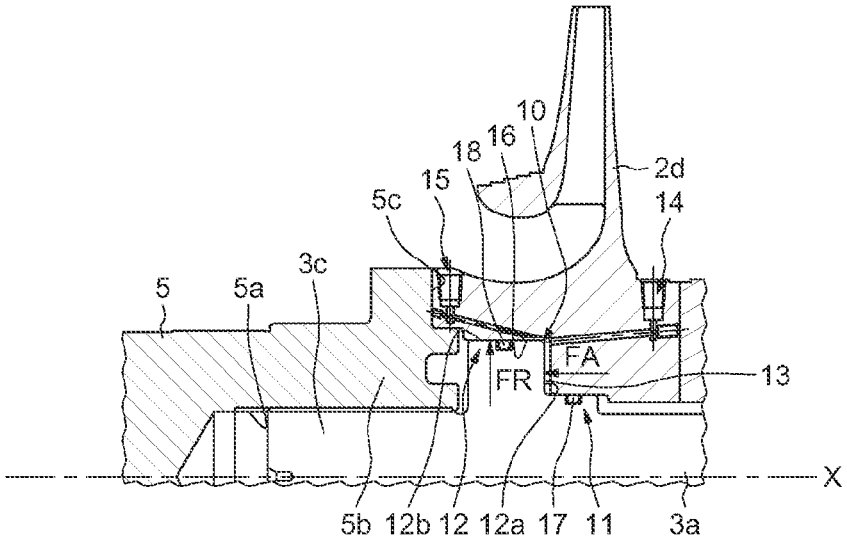
FIG. 2 shows the hydraulic tension device in FIG. 1 in detail.

The rotor structure, of axis X, referenced 1 as a whole in FIGS. 1 and 2, has a plurality of vane wheels 2 or discs stacked axially on a main tie rod 3 and two end shafts 4, 5 each attached to an end of the main tie rod 3.

The main tie rod 3 has a main portion 3*a* passing through the bores formed in each wheel 2 and two threaded end portions 3*b*, 3*c* designed to be screwed into each end shaft 4, 5. For this purpose, the end shafts 4, 5 have blind threaded holes 4*a*, 5*a* whose axial dimension is determined as a function of the desired relative position of the two end shafts 4, 5 when assembly is complete. In the example shown, there are four wheels 2 referenced 2*a*, 2*b*, 2*c*, 2*d*, although a different number of wheels 2 may be used.

The first shaft 4 has for example a constant outer diameter, and the second shaft 5 has for example a decreasing outer diameter, such that it is possible to use a tie rod 3 having a diameter greater than the minimum diameter of the second shaft 5.

The rotor structure 1 also includes a hydraulic tension device 10 designed to preload the main tie rod 3. The tension device 10 is formed by two shoulders 11, 12 formed on the main tie rod 3, which delimit a hydraulic chamber 13 along with an end wheel 2*d* placed at the second end 3*c* of the tie rod 3. The hydraulic chamber 13 is intended to receive a hydraulic fluid via first access means 14 formed in the end wheel 2*d* that lead both outside the rotor 1 and into the hydraulic chamber 13. The access means 14 are machined symmetrically in relation to the axis X of the rotor 1, so as to prevent any mechanical unbalance from occurring. By way of non-limiting example, second access means 15 may be formed in the end wheel 2*d*, as shown. Each shoulder 11, 12 of the main tie rod 3 is in contact with the bore 16 of the end wheel 2*d* and includes an O-ring gasket 17, 18 in order to isolate the hydraulic chamber 13. Thus, the tie rod 3, the hydraulic chamber 13 and the end wheel 2*d* form a hydraulic cylinder.

The rotor structure 1 is assembled as follows.

In a first step, the first end shaft 4 is assembled vertically with all of the wheels 2. The first wheel 2*a* is in contact with the first shaft 4 and the last wheel 2*d* is designed to be in contact with the second shaft 5 when assembly is complete. Alternatively, the first step may be performed horizontally with the use of suitable tools (not shown).

In a second step, the first threaded end portion 3*b* is centered and screwed into the threaded hole 4*a* of the first shaft 4. The main tie rod 3 is tightened until it abuts against the bottom of the threaded hole 4*a* of the first shaft 4, before being slightly unscrewed. This unscrewing may be modified as a function of the desired angular position between the second shaft 5 and the wheels 2 when assembly is complete.

Once the main tie rod 3 has been screwed and positioned axially in the first shaft 4, the hydraulic tension device 10 is pressurized using the access means 14, 15. Alternatively, the access means 14, 15 may be located on another side of the last wheel 2*d*. Several access means may also be provided. When pressurizing the hydraulic chamber 13, the radial surface 12*a* of the second shoulder 12 of the tie rod 3 determined by the difference in radius between the two shoulders 11, 12 combined with the pressure of the fluid in the hydraulic chamber 13 generates an axial preloading force $F_A$ on the main tie rod 3. The preload may be modified by modifying one of these parameters.

The axial surface 12*b* of the second shoulder 12 of the tie rod 3, determined by the axial distance between the two gaskets 17, 18 combined with the pressure of the fluid generates a radial force $F_R$ that tends to radially expand the hydraulic chamber 13. This axial distance is determined so as not to damage the last wheel 2*d*, to prevent any leaks of hydraulic fluid around the gaskets 17, 18, but to enable the consecutive assembly of the second shaft 5 on the main tie rod.

Indeed, in the next fourth step of assembly, the second shaft 5 is screwed to the second threaded end portion 3*c* of the main tie rod 3 until axial contact is reached between a bearing surface 5*c* of the second shaft 5 and the last wheel 2*d*.

Alternatively, to improve precision, a first assembly may be effected in order to mark the docking position between the second shaft 5 and the last wheel 2*d*.

On completion of assembly, the fluid pressure in the hydraulic chamber 13 is released and the hydraulic chamber 13 is drained. The access means 14, 15 are then left open so as not to create a closed zone with an uncontrolled pressure. After the pressure is released in the hydraulic chamber 13, the last wheel 2*d* is tightened against the second shaft 5 so as to obtain a tightened assembly of the wheel 2*d* on the shaft 5, without using other means such as, for example, heating of the parts. The shaft 5 is in this case provided with an axial cylindrical extension 5*b* constituting a centering portion such that the last wheel 2*d* is also centred.

Thanks to the described embodiments, the holes 4*a*, 5*a* can be made blind in the end shafts, which reduces the risk of leaks in the case of a compressor. In such a rotor structure 1, it is possible to use a tie rod 3 having a larger diameter that is not limited in relation to the diameter of the second shaft 5, and a tie rod 3 having a shorter axial dimension, thereby enabling the risk of vibration in the tie rod 3 to be limited. The hydraulic tension device 10 enables the main tie rod 3 to be preloaded radially and axially.

Figure 3:
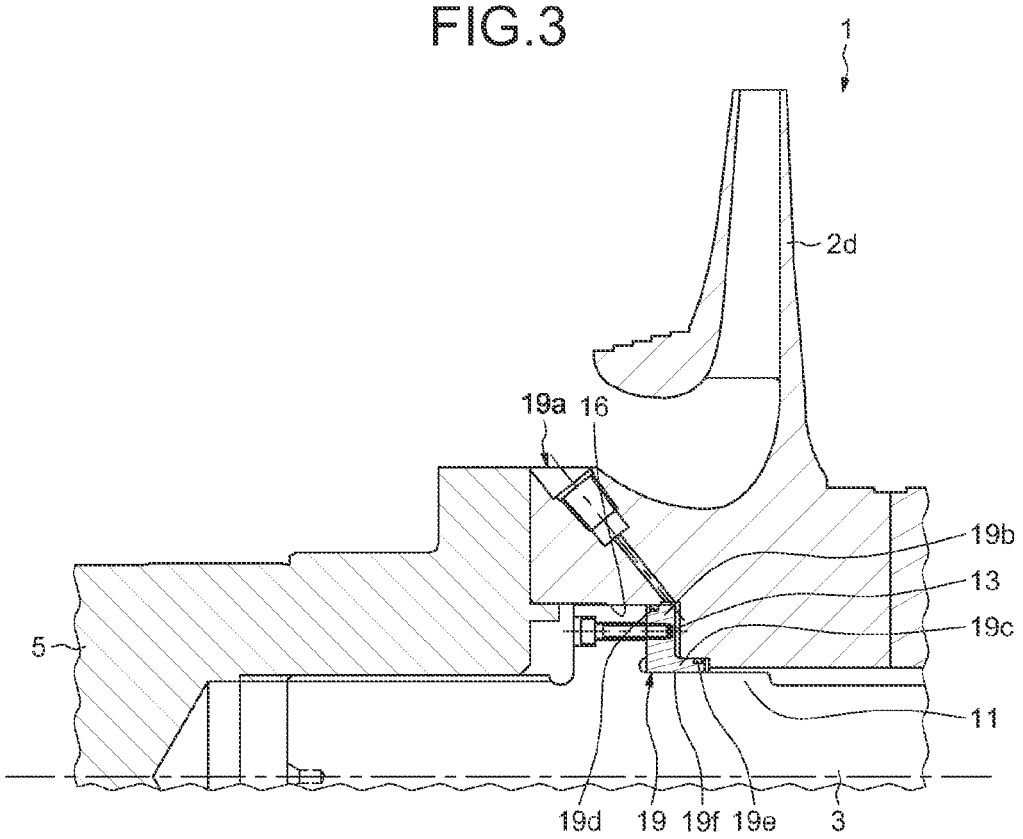
FIG. 3 is an axial view of a rotor structure according to an embodiment of the invention.

FIG. 3 shows a rotor structure 1 similar to the one shown in FIG. 1, the common elements having common reference signs. The hydraulic chamber 13 shown in FIG. 3 is delimited by the main tie rod 3 and a supplementary annular element 19 arranged, for example, between the main tie rod 3 and the last wheel 2*d*. The hydraulic chamber 13 is designed to receive a hydraulic fluid via first access means 19*a* formed in the end wheel 2*d* that lead both outside the rotor 1 and into the hydraulic chamber 13. The access means 19*a* are machined symmetrically in relation to the axis X of the rotor 1, so as to prevent any mechanical unbalance from occurring.

For example in FIG. 3, the annular element 19 includes two shoulders 19*b*, 19*c*, each in contact with the bore 16 of the end wheel 2*d* and it includes an O-ring gasket 19*d*, 19*e* to isolate the hydraulic chamber 13. The annular element 19 is fixed to the central tie rod 3 using bolts (not referenced). Alternatively, the annular element 19 may be a threaded insert, for example a nut, on the main tie rod 3. Thus, the tie rod 3, the annular element 19, the hydraulic chamber 13 and the end wheel 2*d* form the hydraulic tension device 10 and act as a hydraulic cylinder.

As shown, the bore 19*f* of the annular element 19 is in contact with the shoulder 11 of the main tie rod 3.

Thus, the annular element 19 bearing the hydraulic sealing elements is added to the structure of the tie rod to facilitate certain aspects of assembly, the hydraulic force being transmitted to the main tie rod 3 during assembly via axial contact elements such as for example the shoulder 12 of the main tie rod 3 or the thread of the annular element 19.

Figure 4:
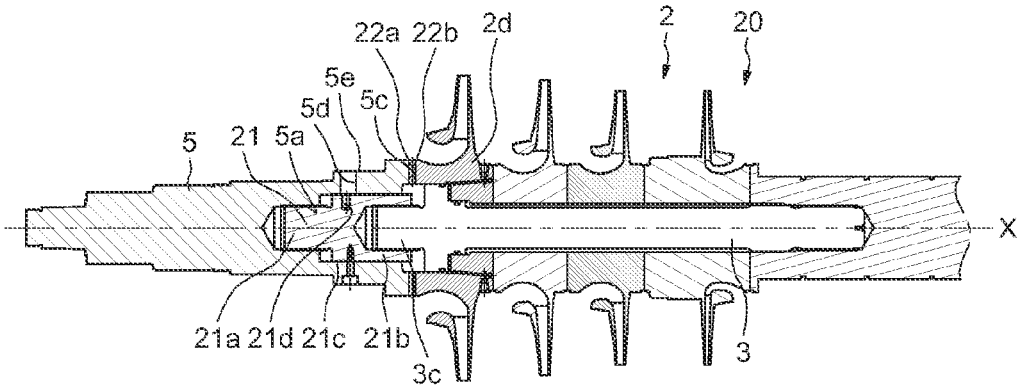
FIG. 4 is an axial view of a rotor structure according to an embodiment of the invention.
Figure 5A:
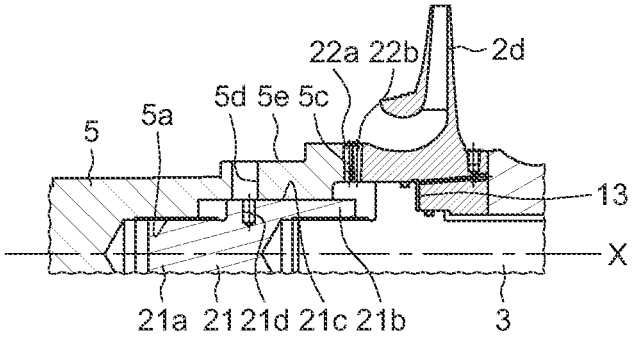
FIGS. 5*a* and 5*b* show the hydraulic tension device in FIG. 4 in detail.
Figure 5B:
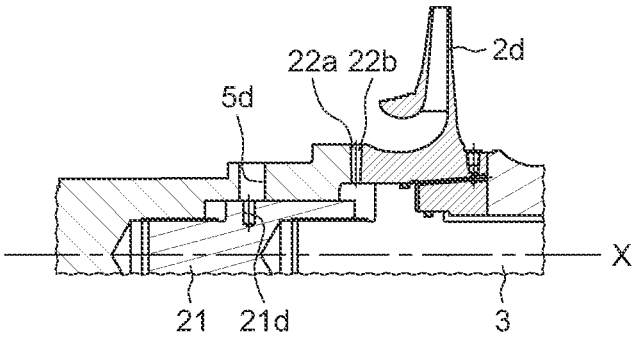

FIGS. 4, 5*a* and 5*b* show a rotor structure 20 similar to the one shown in FIG. 1, the common elements having common reference signs. The rotor structure 20 shown in FIG. 4 includes a supplementary tie rod 21 to enable the use of cogging 22*a* on the contact surface 5*c* of the second shaft 5 cooperating with the cogging 22*b* of the last wheel 2*d*. It will be noted that this cogging is for example arranged radially on each of the surfaces opposite the second shaft 5 and the last wheel and they have an overall tapered shape along the longitudinal cross section. Thus, the second shaft 5 is centred on the end wheel 2*d* in this case by the cogging 22*a*, 22*b*. Radial expansion is therefore no longer required.

On one side, the supplementary tie rod 21 has a threaded male part 21*a* designed to be screwed into the threaded hole 5*a* of the second shaft 5 and a threaded female part 21*b* designed to be screwed onto the second threaded end portion 3*c* of the main tie rod 3.

The supplementary tie rod 21 has notches 21*d* on the external cylindrical surface 21*c* thereof that are designed to cooperate with an external tool (not shown) to tighten and unscrew the supplementary tie rod 21. Alternatively, cogging or axial grooves may be used. Access holes 5*d* for the notches 21*d* are formed for this purpose on the cylindrical surface 5*e* of the second shaft 5.

The rotor structure 20 is assembled as follows.

The first, second and third steps are identical to the first, second and third steps for assembling the structure of the rotor 1 in FIG. 1. After the pressurization step of the hydraulic chamber 13, the male part 21*a* of the supplementary tie rod 21 is screwed onto the second shaft 5. After tightening, the unit formed by the supplementary tie rod 21 and the second shaft 5 is locked in rotation by an external tool (not shown).

In a fifth step, the unit is then screwed to the main tie rod 3 via the female part 21*b* of the supplementary tie rod 21 until the desired angular position between the second shaft 5 and the last wheel 2*d* is achieved, i.e. without contact of the cogging 22*a*, 22*b*, as shown in FIG. 4*a*.

In a sixth step, rotation of the second shaft 5 and of the supplementary tie rod 21 is released and the supplementary tie rod 21 is slightly tightened using the notches 21*d* formed on the external cylindrical surface 21*c* of the supplementary tie rod 21 until the cogging 22*a* of the second shaft 5 meshes with the cogging 22*b* of the end wheel 2*d*. The direction of the threads of the male part 21*a* and of the female part 21*b* of the supplementary tie rod 21 is selected so as to simultaneously tighten the second shaft 5 and the main tie rod 3 when the supplementary tie rod 21 is rotated, so as to create a translational movement between the second shaft 5 and the end wheel 2*d*. Alternatively, several notches may be provided on the external cylindrical surface of the supplementary tie rod and several holes on the second shaft so as to have at least one notch accessible regardless of the position of the supplementary tie rod.

Once the second shaft 5 and the end wheel 2*d* are fixed by their respective cogging 22*a*, 22*b*, the pressure of the fluid in the hydraulic chamber 13 is released, then the hydraulic chamber 13 is purged, in order to establish a final axial stress on the main tie rod 3.

Figure 6:
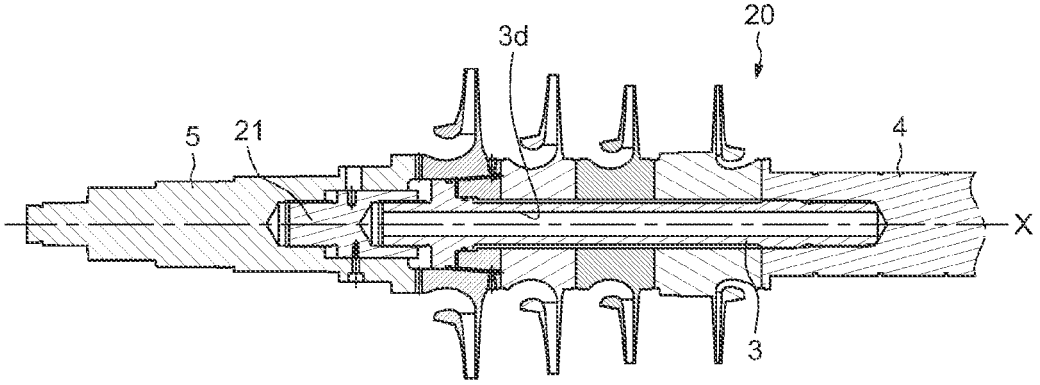
FIG. 6 is an axial view of a rotor structure according to an embodiment of the invention.
Figure 7:
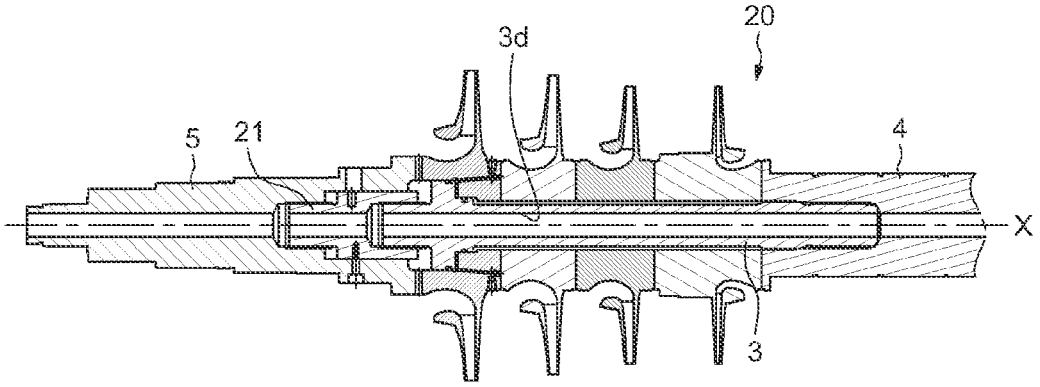
FIG. 7 is an axial view of a rotor structure according to an embodiment of the invention.

FIGS. 6 and 7 show variations applied to the rotor structure in FIG. 3. Nonetheless, these variations could equally be applied to the rotor structure shown in FIGS. 1 and 2.

FIG. 6 shows a rotor structure 20 as described in FIG. 4. FIG. 6 and FIG. 4 include similar elements having similar reference signs. The main tie rod 3 has a hole 3*d* along the entire axial length thereof so as to modify the thermal inertia of the main tie rod 3. Alternatively, the supplementary tie rod 21 may also be hollow.

FIG. 7 shows a rotor structure 20 as described in FIG. 4. FIG. 7 and FIG. 4 include similar elements having similar reference signs. In the example shown, the main tie rod 3 and the supplementary tie rod 21 are hollow, along with the two end shafts 4, 5, so as to optimize, for example, the dynamics of the rotor, the thermics of the rotor, or tool access enabling the supplementary tie rod to be tightened, and to ensure fluid recirculation between the different parts of the compressor. Such recirculation may be passive or active and for example intended to reduce the thermal fatigue cycles in the case of hot compressors. This configuration also enables a fluid to be forced into the rotor in a manner controlled by an external loop.

This configuration can only be used if the sealing of the end shafts is not an essential parameter.

Embodiments of the present invention are not limited to a hydraulic device as described above. Indeed, the presence of an annular element attached to the main tie rod may be applied to the embodiments in FIGS. 4 to 7 without any major modifications.

The end shafts could also be attached to the main and/or supplementary tie rod using unthreaded means, such as for example expandable sleeves or a quarter-turn assembly.

In all of the embodiments described, the configuration of the rotor structure is simple to assemble and provides a hydraulic tensioning device inside the structure, without any offset-weight elements at an extremity of the structure. Furthermore, such a configuration enables the stress applied to the main tie rod to be precisely controlled.

Embodiments of the present invention provide an axially stacked rotor structure that is easy to assemble, that does not adversely affect the mechanical behaviour of the shaft on account of an offset weight or a long center-to-center distance and for which the tie rod is preloaded as precisely as possible.

Embodiments of the present invention also enable the use of tie rods having a diameter substantially identical to or greater than the diameters of the shaft ends.

According to an embodiment of the present invention, the main tie rod may have two shoulders, directly on the main tie rod or on an intermediate annular element attached to the main tie rod, delimiting, with the bore of an end wheel in contact with one of the shafts, a chamber designed to receive a hydraulic fluid, the main tie rod, the hydraulic chamber and said end wheel forming an internal hydraulic tension device designed to preload the main tie rod.

Since the hydraulic tension device is inside the structure of the rotor, no offset mass is added to the extremity of the shaft, which prevents the dynamic of the rotor from being adversely affected and enables the axial dimension of the structure of the rotor to be reduced. Furthermore, it is possible to use a tie rod having a larger diameter that is not limited in relation to the diameter of the second shaft, and a tie rod having a shorter axial dimension, thereby enabling the risk of vibration in the tie rod to be limited.

Each shoulder of the main tie rod or of the annular element may include sealing means in contact with the bore of the end wheel, the shape of said bore being complementary to the cylindrical surface both of the main tie rod and of the annular element.

The end wheel may include first access means leading both to the outside of the rotor and into the hydraulic chamber, the access means being symmetrical in relation to the axial axis of the rotor so as not to create balance problems in the latter.

The second shaft may include means for centering the end wheel, comprising for example an annular skirt in axial contact with the end wheel.

According to an embodiment of the present invention, the first shaft has a threaded hole cooperating with the first threaded end of the main tie rod and the second shaft has a threaded hole cooperating with a second threaded end of the main tie rod.

For example, the respective threaded holes of the first and second shafts may or may not be through-holes, depending on the constraints of the structure.

In one embodiment, the rotor structure includes a supplementary tie rod having a threaded male part cooperating with the threaded hole of the second shaft and a threaded female part cooperating with the second threaded end of the main tie rod.

In this case, the centering means may include front cogging formed in the second shaft and in the end wheel.

The supplementary tie rod may be hollow.

The main tie rod may have a hole along the entire axial length thereof.

According to an embodiment of the present invention, the hydraulic chamber is pressurized, the pressure is released and the hydraulic chamber is drained using first access means formed in the end wheel that lead both to the outside of the rotor and into the hydraulic chamber, the access means being symmetrical in relation to the axial axis of the main tie rod.

The first end of the main tie rod may be screwed into the threaded hole in the first shaft until it abuts thereagainst.

The second shaft may be screwed to the second threaded end of the main tie rod or attached using a supplementary tie rod.

What is claimed is:

1. A rotor structure comprising:

a plurality of wheels;

a main axial tie rod passing through the plurality of wheels; and a first shaft and a second shaft each attached to one extremity of the main tie rod, wherein the main tie rod has two shoulders with faces defined by the contour of the main tie rod and an annular element mounted to the main tie rod, and a bore with a face opposing a shoulder of an end wheel in contact with one of the first and second shafts delimit a hydraulic chamber to receive a hydraulic fluid, and wherein the main tie rod, the hydraulic chamber and the end wheel form an internal hydraulic tension device where hydraulic force is applied between a shoulder face and bore face to axially preload the main tie rod when the hydraulic fluid is introduced under pressure in the hydraulic chamber.

2. The rotor structure according to claim 1, wherein each shoulder includes a sealing element in contact with the bore of the end wheel, and wherein the shape of the bore is complementary to the cylindrical surface of the main tie rod.

3. The rotor structure according to claim 1, wherein the second shaft has a centering portion configured to center the end wheel.

4. The rotor structure according to claim 3, wherein the centering portion includes an annular skirt in axial contact with the end wheel.

5. The rotor structure according to claim 1, wherein the first shaft has a threaded hole cooperating with a first threaded end of the main tie rod.

6. The rotor structure according to claim 5, wherein the threaded hole of the first shaft is a through-hole.

7. The rotor structure according to claim 1, wherein the second shaft has a threaded hole cooperating with a second threaded end of the main tie rod.

8. The rotor structure according to claim 7, further comprising a supplementary tie rod having a threaded male part cooperating with the threaded hole of the second shaft and a threaded female part cooperating with the second threaded end of the main tie rod.

9. The rotor structure according to claim 8, wherein the second shaft has a centering portion configured to center the end wheel, and wherein the centering portion includes front cogging formed in the second shaft and in the end wheel.

10. The rotor structure according to claim 8, wherein the supplementary tie rod is hollow.

11. The rotor structure according to claim 7, wherein the threaded hole of the second shaft is a through-hole.

12. The rotor structure according to claim 1, wherein the main tie rod has a hole along the entire axial length thereof.

13. A method for assembling a rotor structure having a plurality of wheels, a main axial tie rod passing through the plurality of wheels, and a first shaft and a second shaft, the method comprising:

assembling the plurality of wheels with the first shaft;

centering a first end of the main tie rod on the first shaft and attaching the first end of the main tie rod to the first shaft;

pressurizing a hydraulic chamber, the hydraulic chamber being delimited by two shoulders of the main tie rod, a bore of an end wheel with a face, and an annular element attached to the main tie rod, each shoulder with a face, wherein application of hydraulic fluid for pressurization exerts force between a face of a shoulder and the face of the bore of the end wheel;

wherein the main tie rod, the hydraulic chamber, and the end wheel forms an internal hydraulic tension device configured to axially preload the main tie rod;

positioning and attaching the second shaft to a second end of the main tie rod opposite the first end of the main tie rod such that the second shaft is closer to the end wheel; and releasing the pressure and draining the hydraulic chamber, wherein the hydraulic chamber is pressurized, the pressure is released and the hydraulic chamber is drained by a first access means formed in the end wheel that leads to the outside of the rotor and into the hydraulic chamber, the first access means being symmetrical in relation to the axial axis of the main tie rod.

14. The method according to claim 13, wherein the first end of the main tie rod is screwed into a threaded hole in the first shaft until the first end abuts against the first shaft.

15. The method according to claim 13, wherein the second shaft is screwed to a second threaded end of the main tie rod.

16. The method according to claim 13, wherein the second shaft is attached to the main tie rod by a supplementary tie rod.

* * * * *